US005606913A

United States Patent [19]

Kowalewski

[11] Patent Number: 5,606,913

[45] Date of Patent: Mar. 4, 1997

[54] SHEET REGISTRATION CONTROL

[75] Inventor: James M. Kowalewski, Baltimore, Md.

[73] Assignee: Ward Holding Company, Wilmington, Del.

[21] Appl. No.: 528,796

[22] Filed: Sep. 15, 1995

Related U.S. Application Data

[63] Continuation of Ser. No. 308,845, Sep. 19, 1994, abandoned, which is a continuation-in-part of Ser. No. 33,097, Mar. 16, 1993, Pat. No. 5,383,392.

[51] Int. Cl.[6] ..... B41F 5/02; B41F 1/28

[52] U.S. Cl. ..... 101/183; 101/232

[58] Field of Search ..... 101/183, 185, 101/232, 181, 219, 484, 211, 485, 486, 216, 248; 271/198, 199, 202, 203

[56] References Cited

U.S. PATENT DOCUMENTS

| | | | |
|---|---|---|---|
| 4,095,511 | 6/1978 | Woolston . | |
| 4,458,893 | 7/1984 | Ruh . | |
| 4,471,693 | 9/1984 | Tsukasaki . | |
| 4,494,745 | 1/1985 | Ward, Sr. et al. . | |
| 4,515,079 | 5/1985 | Dahlgren . | |
| 4,515,470 | 5/1985 | Deckers | 355/105 |
| 4,527,788 | 7/1985 | Masuda . | |
| 4,567,824 | 2/1986 | Dahlgren et al. . | |
| 4,604,083 | 8/1986 | Barny et al. . | |
| 4,632,378 | 12/1986 | Sardella . | |
| 4,774,446 | 9/1988 | Salazar et al. . | |
| 4,847,775 | 7/1989 | Roch et al. . | |
| 5,050,994 | 9/1991 | Kipphan | 356/445 |
| 5,074,539 | 12/1991 | Wells et al. . | |
| 5,094,442 | 3/1992 | Kamprath . | |
| 5,103,733 | 4/1992 | Drapatsky . | |
| 5,213,036 | 5/1993 | Takuno et al. . | |

FOREIGN PATENT DOCUMENTS 2083449 3/1982 United Kingdom .

OTHER PUBLICATIONS

"Board Converting News" published 14 Jan. 91, vol. 5, No. 1, pp. 1 & 2.

Brochure entitled "Autotron 275" by Crossfield Controls, published before 1991.

*Primary Examiner*—J. Reed Fisher

*Attorney, Agent, or Firm*—Bartlett & Sherer

[57] ABSTRACT

A sheet processing apparatus, for example for flexographic printing and die-cutting of corrugated paperboard container blanks, has first and second successive processing sections connected by a transfer section. The sheets are successively passed through the various sections in positional registrations therewith. A sensor senses a sheet while in the transfer section and provides a signal representative of the positional registration of the sheet in the transfer section. A computer system determines from the signal whether the sheet would enter the second section in correct positional registration for processing by the second section, and adjusts as necessary the positional registration of the sheet while in the transfer section to cause the sheet to enter the second section in correct positional registration therewith. Preferably, the transfer section is a vacuum conveyor independently driven by one or more electric servo motors; the conveyor being both accelerated and decelerated to adjust sheet registration, and thereafter, the conveyor is returned to its original linear position without effecting the registrational position of the sheet.

11 Claims, 6 Drawing Sheets

SHEET REGISTRATION CONTROL

This application is a Continuation of application Ser. No. 08/308,845, filed Sep. 19, 1994, now abandoned, which is a Continuation-In-Part of application Ser. No. 08/033,097, filed Mar. 16, 1993, now U.S. Pat. No. 5,383,392.

FIELD OF THE INVENTION

This invention relates to apparatus and method for successively passing sheets through successive processing sections while desirably maintaining register of each sheet through each processing section. The invention is particularly concerned with processing container blanks comprising sheets of corrugated paperboard.

BACKGROUND OF THE INVENTION

During the processing of container blanks, paperboard sheets are successively passed through successive processing sections such as printing and die-cutting. Printing can have one, two, three or more printing sections and may employ one or more colored inks. Another section may include creasing. These various sections are rotationally (ie angularly) timed relative to each other so that each sheet theoretically passes through each section in register therewith. As the various operating members of the processing sections rotate in contact with successive sheets, each section is intended to perform an operation in the correct position on the sheet. In this way, all the operations get superimposed on top of each other on the sheet to form the final product, e.g. a printed container blank. Should any operation not be correctly positioned on the sheet, then the sheet is said to be out of registration, or out of register, with that operation, and this produces an inferior processed sheet.

The need to maintain accurate registration of paperboard sheets in the production of color printed container blanks has become more critical with higher production speeds and the demand for higher quality printing and multi-color graphics.

SUMMARY OF THE INVENTION

The present invention is concerned with improving the accuracy of positional registration when a multiplicity of sheets are moved successively through a plurality of processing sections.

One feature of the present invention involves sensing and adjusting registration of a sheet in a transfer section between two consecutive processing sections.

This has the advantage of enabling any out-of-registration of a sheet to be corrected before the sheet enters the next processing section. Even though all of the processing sections may be in register with each other, a particular sheet may be displaced from correct registration by an operating member, by drag forces or by slipping relative to a forwardly conveying member. The present invention provides a way for correcting such incorrect sheet registration that may develop, thereby mitigating any adverse effect upon the processed sheet.

The present invention is applicable to carton blank processing machines in which adjacent sections are driven by different motors, for example when driving each section with its own computer controlled electric "servo" motor. However, the invention is also applicable to processing machines in which all, some, or most, of the sections are driven from a common drive, for example by way of gearing between sections or a shaft drive between sections.

Accordingly, therefore, there is provided by one aspect of the present invention a sheet processing apparatus having first and second sheet processing sections successively arranged with the second sheet processing section downstream of the first sheet processing section and a transfer section between the first and second sections for transferring sheets from the first section to the second section. Sensor means sense a sheet in the transfer section and provide a signal representative of positional registration of the sheet in the transfer section. Control means determine from the signal whether the sheet would enter the second section in correct positional registration for processing by the second section, and adjust as necessary the positional registration of the sheet while in the transfer section to cause the sheet to enter the second section in correct positional registration therewith.

The transfer section may comprise a driven conveyor.

The control means may include adjusting means for accelerating and decelerating the conveyor.

The control means may include adjusting means for changing the driven conveyor to correct any skew disposition of the sheet.

Preferably, a transfer section sensor indicates sheet position, and program logic control of the machine measures any error between machine timing and the signal from the sensor and then adjusts the transfer section to eliminate the error.

The adjusting means may function, responsive to the signal, to accelerate the conveyor in its direction of travel before the sheet enters the second section, and then after such acceleration to decelerate the conveyor in its direction of travel before the next sheet enters the transfer section from the first section.

Preferably, the conveyor is independently driven by at least one computer controlled servo motor.

Preferably, the control means includes adjusting means for accelerating and decelerating the drive of the transfer section, and the adjusting means functions in response to the signal to accelerate and decelerate the transfer section drive before the sheet enters the second section.

The adjusting means may function, responsive to the signal, to advance one side of the conveyor in its direction of travel relative to the other side to correct any skewness of the sheet before the sheet enters the second section. To achieve this, one side of the conveyor can be accelerated and then decelerated relative to the other side; at the same time both sides may be additionally accelerated and retarded to correct angular registration.

Preferably, the transfer section comprises a vacuum conveyor having at least one pair of endless belts with vacuum apertures therein, means for adjustably displacing one of the belts relative to the other to position the vacuum apertures in accordance with a predetermined sheet size, and the control means may function to drive both of the belts at the same speed when transferring each sheet from the first section to the second section.

The drives to the various processing sections may comprise individual servo motors or may comprise gearing or other transmissions from a shared or common main drive motor.

According to another aspect of the present invention, there is provided a method of processing sheets, comprising the steps of feeding sheets successively in correct registration to a first processing section, passing the sheets successively through the first processing section while carrying out a first process on each sheet, conveying the sheets successively from the first processing section to a second processing section, passing the sheets successively through the second processing section while carrying out a second process on each sheet, determining during the conveying step whether each sheet will enter the second processing section in correct registration therewith, and if not, then adjusting the registration of that sheet during the conveying step to cause that sheet to enter the second processing section in correct registration therewith.

Adjusting the registration of that sheet may be achieved by accelerating the sheet while travelling in its direction of travel followed by decelerating the sheet while still travelling in its direction of travel. The adjusting of the registration may comprise correcting any skewness of the sheet by advancing one side of the sheet relative to an opposite side of the sheet. The adjusting may correct both longitudinal (ie angular) registration and skewness registration.

There may be more than two successive processing sections, and the conveying step may occur between every two adjacent processing sections with registration of each sheet being checked and corrected during each conveying step.

The invention is particularly applicable to container blank processing apparatus having at least one or more flexographic printing sections and one or more other processing sections. Each processing section may advantageously be driven by its own computer controlled servo motor, and a transfer section used between adjacent processing sections to check and correct, as necessary, registration of each sheet leaving one section and before the sheet enters the next section.

According to another aspect of the present invention, the linear position of the transfer conveyor may be further adjusted at some time subsequent to a given sheet entering the next section in register therewith. Such linear position adjustment of the transfer conveyor may be made after each acceleration and deceleration to correct sheet registry, or the linear position adjustment may be made after a predetermined number of such accelerations and decelerations.

Other objects, features and advantages of the present invention will become more fully apparent from the following detailed description of the preferred embodiment, the appended claims and the accompanying drawings.

BRIEF DESCRIPTION OF THE DRAWINGS

In the accompanying drawings, in which like reference characters indicate like parts.

DETAILED DESCRIPTION OF PREFERRED EMBODIMENTS

Figure 1:
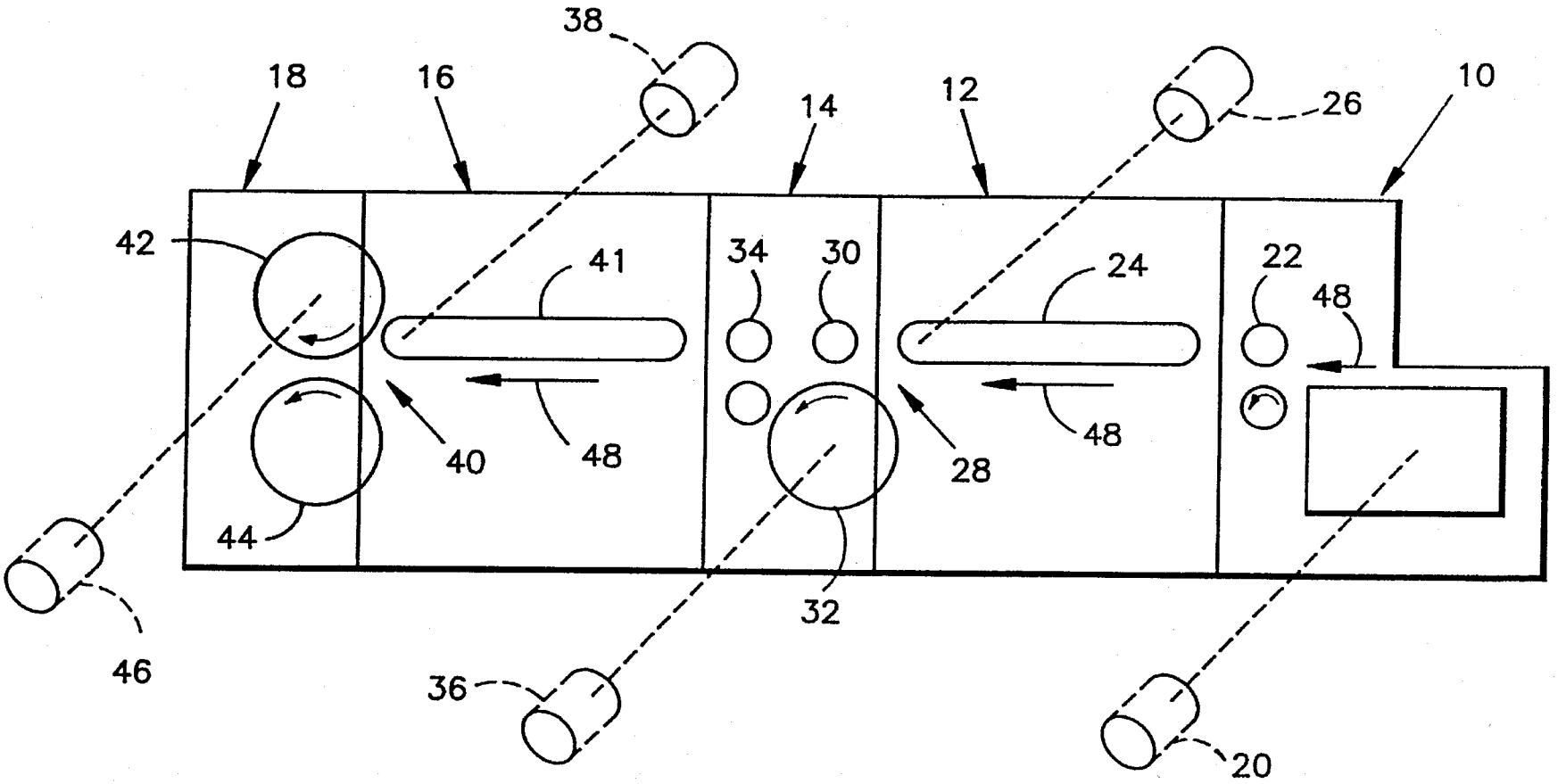
FIG. 1 is a diagrammatic side view of a sheet processing apparatus according to the invention.
Figure 2:
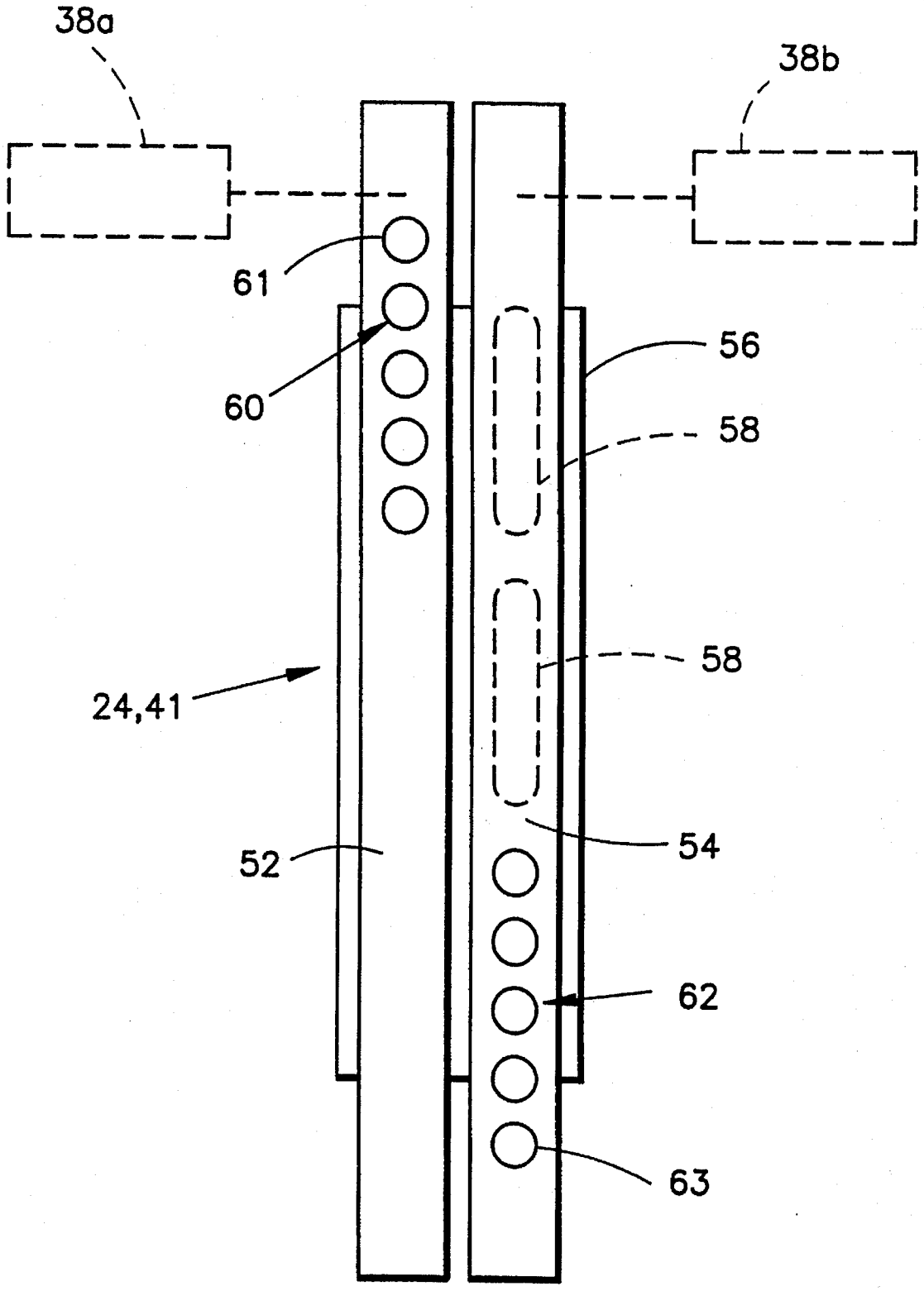
FIG. 2 is a simplified bottom plan view of a preferred transfer section of the apparatus of FIG. 1.
Figure 3:
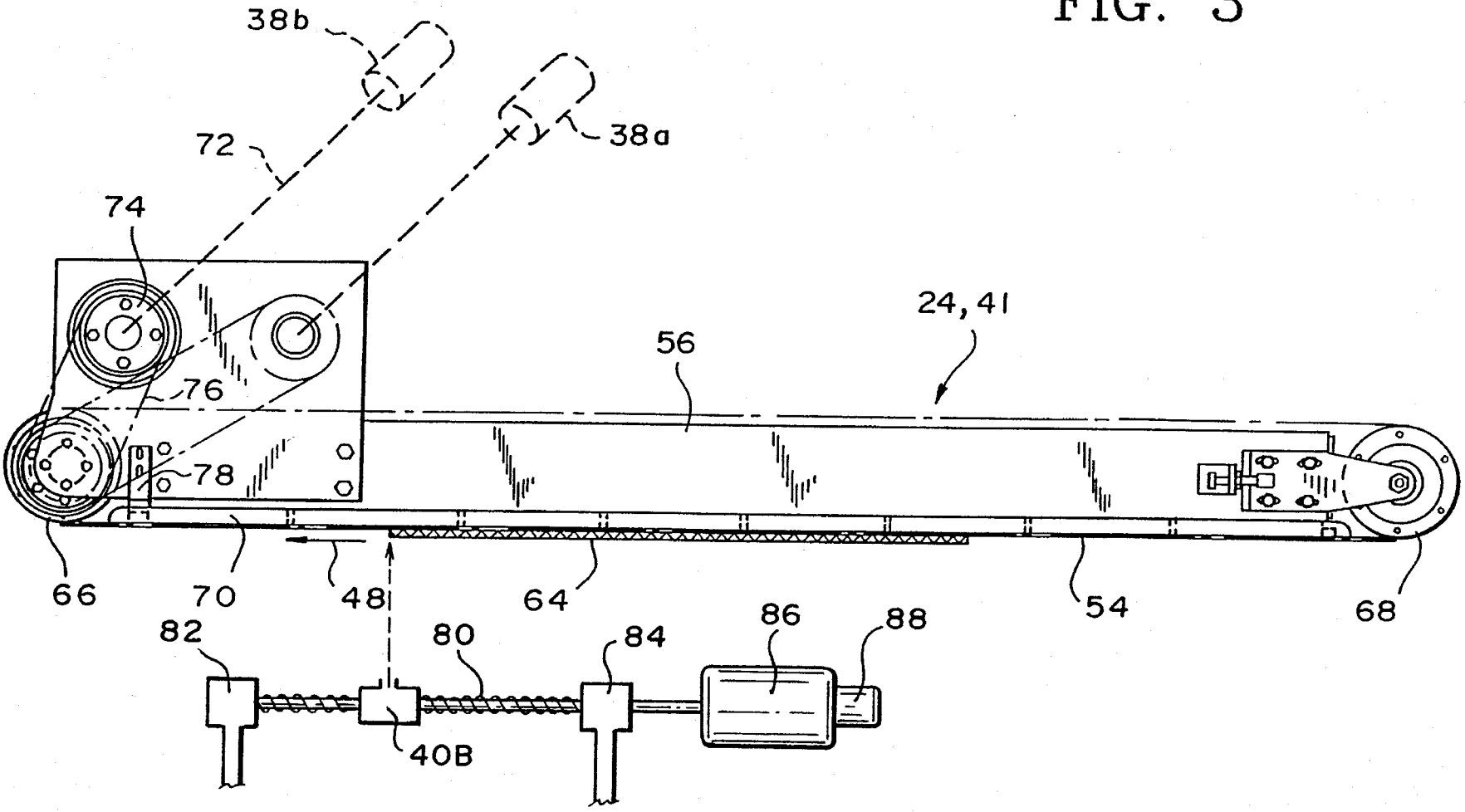
FIG. 3 is a side view of the preferred transfer section of FIG. 2.

One preferred embodiment of the invention relates to a flexographic die-cut machine for producing printed container blanks from sheets of corrugated paperboard as illustrated in FIG. 1, and one preferred transfer section is shown in FIGS. 2 and 3.

FIG. 1 illustrates the flexographic die-cut machine having a lead-edge feed section 10, a first transfer section 12, a flexographic printing section 14, a second transfer section 16, and a die-cut section 18. The feed section 10 may be as more fully disclosed in U.S. Pat. No. 4,494,745, or preferably U.S. Pat. No. 5,074,539, but is driven by its own individually controlled electric servo motor 20. A pair of pull rolls 22 grip each sheet fed from the lead-edge feeder and forward the sheet to the transfer section 12. The transfer section 12 is an overhead vacuum conveyor 24 and is independently driven by a servo motor 26. A sensor 28, preferably a high speed photo sensor, is positioned intermediate the length of, and adjacent the discharge end of, the conveyor 24. The sensor may be positioned below or above the line of travel of the sheets, or board line, represented by numeral 48.

Conveyor 24 delivers the sheets successively between an impression roll 30 and a print cylinder 32 of the flexo section 14. FIG. 1 illustrates a single printing or flexo section for the sake of simplicity. However, it will be understood that, in actual practice, section 14 may in fact comprise a plurality of printing sections wherein each such section has a corresponding print cylinder and impression roll whereby the sheets are successively printed, such as with different color inks, as the sheets pass through each section. It is also to be understood that such a plurality of print sections may be driven by either independent motors, or by a single motor through multiple gears, and that the sheets may be conveyed from one print section to the next by conventional feed rolls, such as feed rolls 34, or by an intermediate transfer section such as transfer sections 12 and 16 which will be described more fully hereinafter.

As illustrated in the FIG. 1 embodiment, flexo section 14 is driven by an individually controlled electric servo motor 36, and the second transfer section 16 is independently driven by a servo motor 38. The second transfer section 16, which has a sensor 40 the same as the sensor 28 and a vacuum conveyor 41 the same as the conveyor 24, feeds each sheet through the nip of a die-cut roll 42 and an anvil roll 44; these rolls of the die-cut section 18 being driven by a servo motor 46. The sheets are fed in the direction of the arrows 48, and the directions of rotation of various rolls are shown by arrows. The various servo motors are controlled by a computer 50 as shown schematically in FIG. 4.

In operation, the leading edge of a sheet while being transported by conveyor 24 is sensed by the sensor 28. The computer 50 (FIG. 4) determines whether the sheet is in register with the flexo section 14. If not, and assuming that the sheet is retarded, then after the trailing edge of the sheet has exited the pull rolls 22, and before the leading edge of the sheet enters the nip of the impression roll 30 with the print cylinder 32, the conveyor belt or belts of the vacuum conveyor 24 are accelerated and decelerated in the longitudinal feed direction 48 to correct the registration of the sheet while in and being conveyed through the transfer section 12. That is, when a sheet is out of register, it usually lags behind the correct registration position, and so the conveyor 24 will be accelerated first to a speed above the normal or line speed, and then be decelerated back to line speed to make the registration adjustment. However, should a sheet be ahead of the correct registration, then the conveyor would be decelerated first from line speed and then accelerated back to line speed to make the registration adjustment. In this way, registration in the direction the sheet is being conveyed (ie angular registration) is corrected as necessary before the sheet is engaged in the next processing section. The sensor 40 and conveyor 41 operate in the same way to correct as necessary the angular registration of the sheet while the second transfer section 16 before the sheet enters the nip between the anvil roll 44 and cutting roll 42.

It will also be understood that, in practice, a sheet processing machine may have different or additional sections such as multiple flexo sections, as previously discussed, and/or one or more creasing and slotter sections, a gluer-folder section, etc. Thus, an individually driven transfer section may be provided between each pair or any pair of adjacent sections for correcting registration of a sheet while the sheet is between any two adjacent sections.

FIG. 2 is an underneath plan view of a preferred form of the vacuum conveyors 24 and 41. In the preferred form, instead of being single conveyor belts, conveyors 24, 41 each comprise a pair of two side-by-side endless conveyor belts 52, 54 having a high coefficient of friction. These belts run around a vacuum box 56 connected continuously to a source of vacuum such as a vacuum pump or blower, or a hooded fan. The vacuum box is provided with a line of slotted apertures under each of the belts 52, 54 for communicating vacuum to the belts, two of such slotted apertures 58 being illustrated in broken lines under the belt 54. Each of the belts 52, 54 have a group or series of apertures 60, 62 located along their length with the group of apertures 60 being spaced ahead of the group of apertures 62. Each belt 52, 54 only acts upon a sheet to convey the sheet when one or more of the apertures in the belt communicate with one or more of the slotted apertures 58 in the vacuum box. Two, three or four of these pairs of belts 53, 54 are spaced apart transversely across each transfer section 12, 16 to act upon each sheet adjacent the sheet's outer edges and preferably additionally midway or partway between the sheet's outer edges. For further details of timed conveyor belts for positioning carton planks see U.S. Pat. No. 4,632,378 which is incorporated herein by reference.

Each belt 52, 54 is driven by a separate electric servo motor 38*a*, 38*b*. When setting-up for a particular size sheet, one of the servo motors 38*a*, 38*b* is operated to move the belts 52, 54 relative to each other until the leading aperture 61 of the group 60 and the trailing aperture 63 of the group 62 are spaced apart just less than the dimension of such sheet parallel to the conveyors 52, 54; typical lengthwise dimensions of sheets being in the range of 15 to 61 inches. Thus, the group of apertures 60 grip the sheet adjacent its leading edge and the group of apertures 62 grip the sheet adjacent its trailing edge. Whether there is a gap between the groups of apertures 60, 62, or whether the groups partially overlap, depends upon the sheet size. As will be appreciated from FIGS. 1 and 3, sheets 64 are being conveyed below the transfer conveyors 24, 41. By applying vacuum via the groups of apertures 60, 62 to the leading and trailing sections of each sheet, the trailing section is prevented from falling away, or dropping down from, the conveyor 24, 41 and there is no wastage of vacuum by a vacuum aperture not being covered.

Once the correct spacing apart of the apertures 61, 63 has been achieved, the servo motors 38*a*, 38*b* then are operated at the same speed so that the belts 52, 54 move in unison and retain the relative positions of the apertures 61, 63. They move in unison during transfer conveying of sheets and also during correction of register.

With the two or more pairs of belts 52, 54, the one servo motor 38*a* may drive all the lefthand (FIG. 2) belts 52 and the one servo motor 38*b* may drive all the righthand belts 54. However, if the facility to also adjust any out-of-skew of the sheets is required, then each pair of belts 52, 54 would have its own individual pair of servo motors 38*a*, 38*b* to enable one pair of belts 52, 54 while moving in unison to be adjusted in longitudinal position relative to another pair of belts 52, 54 also moving in unison.

FIG. 3 shows a side view from the right in FIG. 2 of the preferred vacuum conveyors 24, 41. A corrugated paperboard container blank 64 is shown drawn against and being conveyed by the conveyor belt 54. Pulleys 66, 68 support the conveyor belt at each end, and the lower flight of the belt 54 runs in a longitudinal groove in the lower surface of a wear plate 70 of the vacuum box 56. The servo motor 38*b* drives the pulley 66 via a transmission connection 72, a pulley 74, and a timing belt 76. The servo motor 38*a* similarly drives the forward pulley (hidden behind pulley 66) of the conveyor belt 52 (hidden behind belt 54). The preferred location of sensors 28, 40 is shown at 78 above the lower flight of the conveyor belt 54, adjacent the pulley 66, and just back from the leading edge of the wear plate 70. The sensor 28 or 40 located at 78 senses the leading edge of the blank 64 as the blank passes under the sensor.

The sensors 28, 40 are preferably located above the sheets, and so directed downwardly, as they are then less likely to be susceptible to contamination by dust and scrap coming from the sheets being processed. However, after the first sensor 28 senses the leading edge of a blank sheet fed from the feed section 10, the sheet is then printed in the (or the first) flexo section 14. At this stage, it is possible to print the sheet while in the section 14 with a registration mark. The registration mark (or marks) could be located anywhere on the sheet, but would preferably be at the periphery of the printed matter on the sheet, possibly in an area to be subsequently scrapped, e.g. during die-cutting. As in the embodiments of FIGS. 1 and 3, the printing is on the lower side of the sheet, the subsequent sensor 40 would be below the board line and facing upward when used to sense a registration mark printed on the sheet in flexo section 14. Of course, if printing were arranged to be on the upper side of the sheet, then the subsequent sensors 40 would be located above the board line to sense printed registration marks. When correcting skew registration, registration marks may be printed adjacent opposite sides of the sheet.

Figure 4:
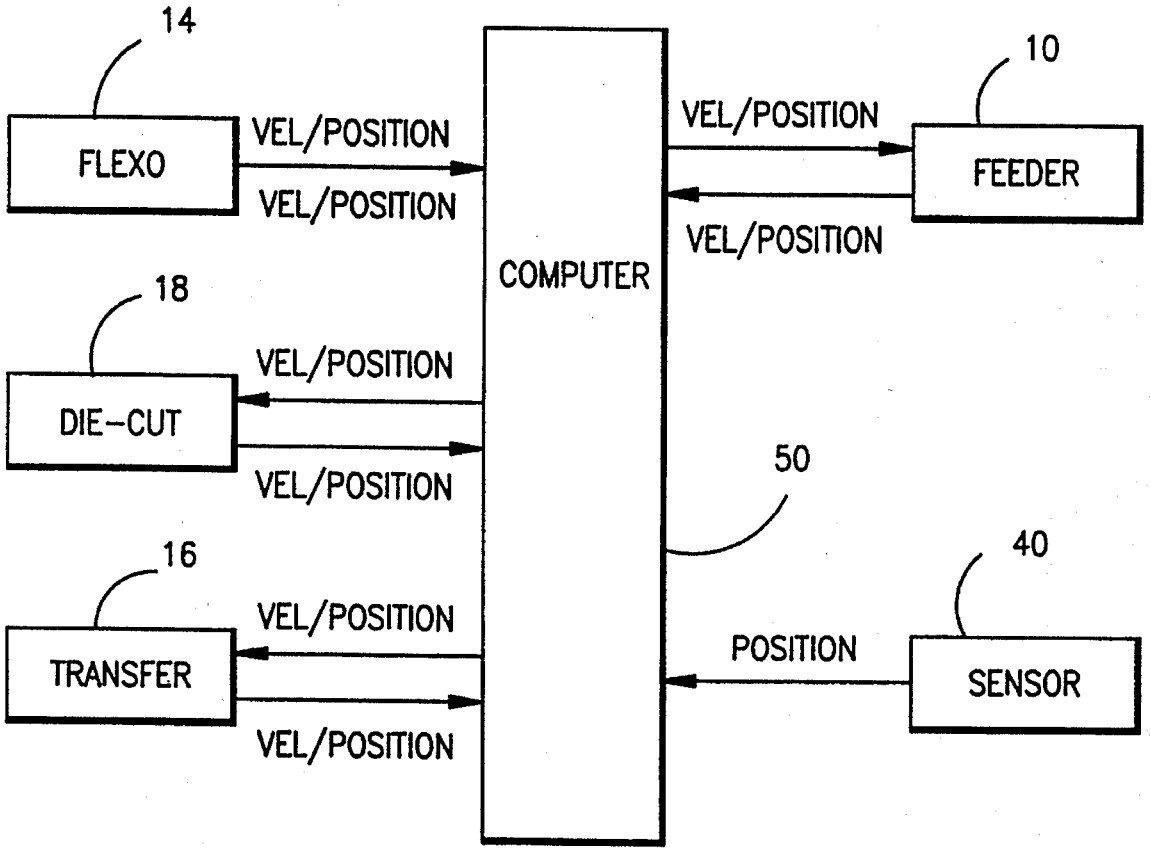
FIG. 4 is a block diagram illustrating the computer control system of the apparatus of FIG. 1.

FIG. 4 illustrates the computer 50 which is located in a control panel of the flexographic die-cut machine of FIG. 1. The timing of the machine for correct registration through each of the sections is determined from the flexographic printing section 14 which sends both a velocity and angular position registration signal to the computer 50. Using this signal, the computer sends a combined velocity and positional registration signal to the servo motors of the sheet feed section 10 and the die-cut section 18. Both these sections 10, 18 send feedback signals to the computer to check (and if necessary correct) their velocities and timing (theoretical registration). Based on the signal received from the die-cut section 18, the computer 50 sends a velocity and positional registration signal to the servo motors of the transfer section 16, and the computer receives a feedback signal to check (and correct if necessary) the velocity and registration timing of the conveyor belts 52, 54. The sensor 40, upon detecting the leading edge of a blank 64, sends a positional signal to the computer 50. The computer uses this signal to check whether this blank is in the correct position in the transfer section 16 to enter the die-cut section 18 in registration therewith. If not, then the computer sends a position adjust signal to the servo motors of the transfer section 16 to correct the position of the blank by rapid acceleration followed by deceleration, the complete correction being accomplished while the lead edge of the blank 64 travels the distance between the sensor 40 and the nip of the rolls 42, 44.

It will be appreciated that the trailing edge of the blank should be clear of control of the previous section before such acceleration and deceleration occurs. If the sections are at 66 inch (168 cm) centers, and a maximum board dimension of 61 inches (155 cm) is to be accommodated, then the distance available for this acceleration and deceleration is only about 5 inches (13 cm), and the linear speed of the conveyor may be as high as 1,000 ft./min. The sensor 40 could be moved beyond the discharge end of the conveyor 41, but this would shorten the distance for the acceleration and deceleration thereby requiring higher values for both and larger servo motors. With the arrangement of FIG. 2 and 3, Indramat servo motors MAC 112 were employed for servos 38*a*, 38*b*, these being constant torque variable speed electric motors. For digital control, it is preferred to use Indramat servo motors MDD 112.

Figure 5:
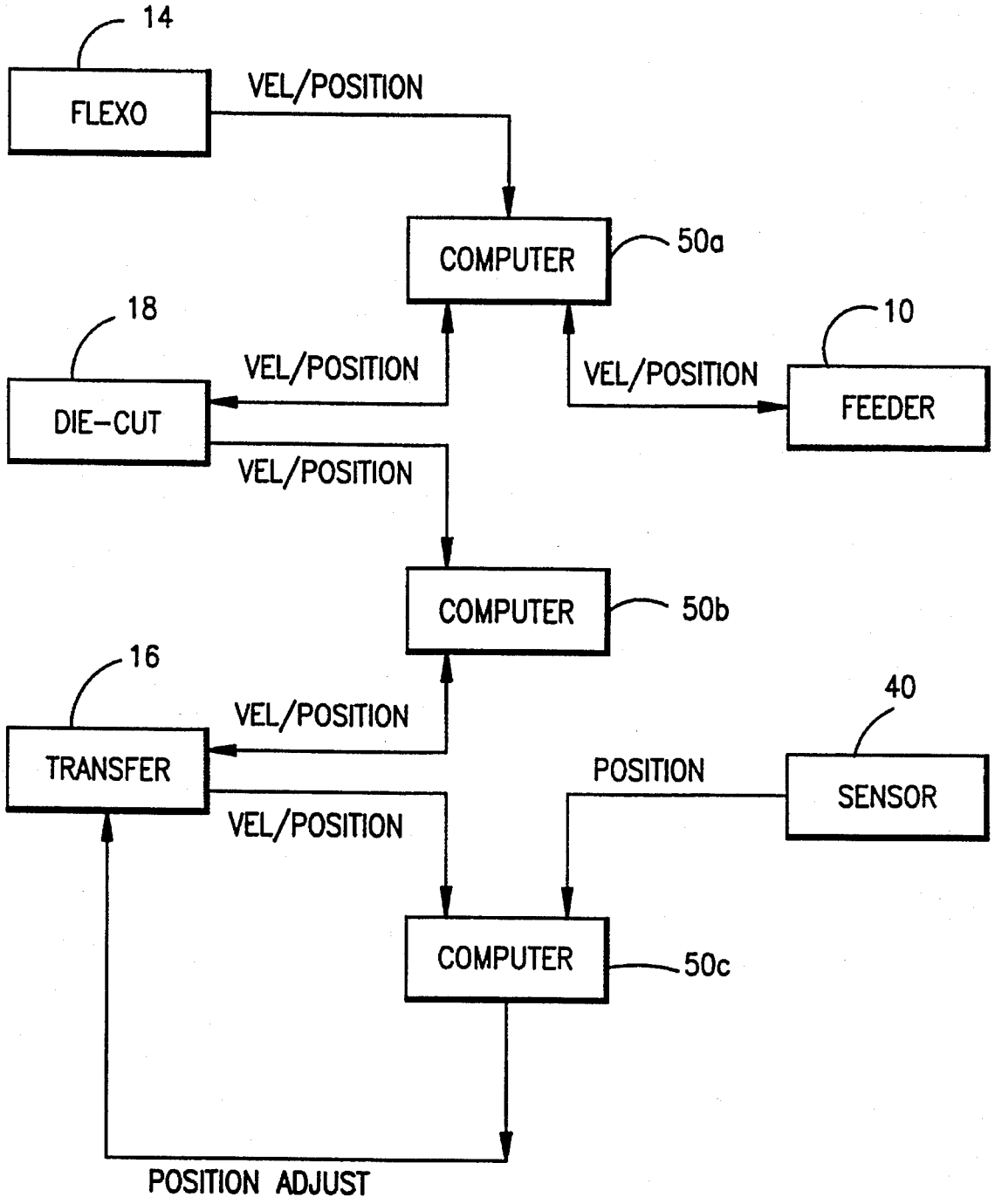
FIG. 5 is the block diagram of FIG. 4 illustrated in a different way to facilitate understanding the invention.

FIG. 5 illustrates the computer control system in a somewhat expanded manner. The controlling velocity/position signal is fed from the flexo section 14 to a first part 50*a* of the computer 50. This computer part 50*a* then feeds velocity/position signals to the servo motors of the die-cut section 18 and the feed section 10, and receives feedback signals from these sections. The die-cut section 18 sends a further velocity/position signal to a second part 50*b* of the computer 50 which in turn sends a velocity/position signal to the servo motors of the transfer section 16 and receives a feedback signal from the transfer section 16. The transfer section 16 sends an output velocity/position signal to a third part 50*c* of computer 50, and a position signal is fed to this computer part 50*c* from the sensor 40. If the position signals are not the same, the computer part 50*c* sends a position adjust signal to the servo motors of the transfer section 16 to effect the necessary acceleration and deceleration to correct the position of the blank 64; ie, to bring the blank 64 into registration with the die-cut section 18 before the blank comes under the control of that section. Of course, computer parts 50*a, b* and *c* may be parts of one computer, or may be several computers packaged together.

The transfer section 12 was omitted from FIGS. 4 and 5 for simplicity. It will be understood that the transfer section 12 is controlled similarly to the transfer section 16, but with the controlling signal for the transfer section 21 coming via the computer from the flexo section 14 and not the die-cut section 18.

It will be appreciated that, if for any reason a sheet blank approaches a processing section out-of-register therewith, either retarded or in advance of its proper position, the registration can be corrected while the sheet is in the transfer section and approaching the next processing section. Whereas the main need due to slippage etc. is to correct angular registration with the next processing section, as explained above, it is also possible to correct skew registration if desired. However, correction of skew errors requires more drive complexities than just correcting angular (phase) registration.

In the operation of the invention as just described it will be understood that, each time the transfer belt is accelerated and decelerated, or decelerated and accelerated, to adjust registration of a sheet, the conveyor becomes slightly advanced, or retarded, in its linear position. That is, the transfer conveyor becomes advanced or retarded relative to where its linear position would have been if the acceleration/deceleration, or vice versa, had not occurred. Since each sheet is usually adjusted only a fraction of an inch, such as in the order of 1/32 of an inch, for example, to correct registration, many such registration adjustments may be made without concern as to the advanced or retarded position of the transfer belt, and to an extent, the advancements of the belt may be partially compensated for by the retarding adjustments. However, registration adjustment is generally required many more times to correct retarded sheets, rather than advanced sheets, such that the overall effect of repeated registration adjustments is that the transfer belt becomes advanced in its linear position. Therefore, at some point, it becomes desirable to return the advanced position of the belt back to where it would have been if one or more registration adjustments had not been made.

Such correction of the linear position of the transfer belt may be accomplished, in the case of the belt being in an advanced linear position, by first decelerating the belt and then immediately accelerating the belt back to the line speed. Conversely, if the belt is in a retarded linear position, then its speed is first accelerated and then decelerated back to the line speed. However, these speed adjustments to correct the linear position of the belt are complicated by the fact that correction of the linear position of the belt must be accomplished without disturbing the registry of the one or more sheets which are engaged on the belt at the time of such correction.

In the present invention, with the dual or side-by-side belts as previously described with reference to FIGS. 2 and 3, correction of an advanced linear belt position is accomplished by first initiating a deceleration of belt 2 only. This is done at a time when at least some of apertures 60 are no longer in engagement with the leading edge of a sheet. That is, belt 52 is decelerated when at least some or all of apertures 60 have moved beyond their last respective vacuum slot 58; ie, beyond the end of vacuum box 56 as viewed in FIG. 3. In this manner, the sheet is still held securely, and in proper registration position, by the vacuum apertures 62, all of which are in engagement with the trailing portion of the sheet. Once belt 52 has been decelerated the proper amount, and for the proper amount of time, as determined by the computer as will be more fully described hereafter, belt 52 is immediately accelerated back to the line speed. Belt 52 is thus returned to its corrected linear position; ie, to the linear position it would have had if registration adjustment had not occurred, and this is accomplished without changing the position of the sheet.

During this correction of belt 52, transfer belt 54 continues to convey the sheet until some or all of apertures 62 move beyond their last vacuum slot 58 at the end of vacuum box 56. At this time, belt 54 is decelerated, and then accelerated back to line speed, so that its linear position is corrected. Thus, the linear position of both belts is corrected so that the cycle of registration adjustment may continue as previously described.

Referring to FIGS. 4 and 5, it will be understood that the correction of the linear position of the transfer belts is accomplished by the same sensors and computer control as previously described, except that, a memory unit 50*d* in computer section 50*c* may be used to store a signal indicative of the amount of displacement of the linear position of the belts during registration adjustment, and this signal is sent to the servo motors 38*a* and 38*b* at the proper times discussed above. For example, an encoder such as encoder 38*c* shown in FIG. 2 may be driven by either of servo motors 38*a* or *b* and the pulses representing each registration adjustment may be counted by memory unit 50*d*. When a predetermined number of registration adjustments have been performed, which may be one or several pulses, memory unit 50*d* sends a signal to the appropriate servo motor to effect the correction as described above.

As previously stated, such correction of the linear position of the belts may be effected after each acceleration and deceleration for registration adjustment, or the cumulative amount of such linear position variations may be calculated by the computer memory over a period of time followed by one correction of the linear position of the belt to correct for multiple adjustments of registration.

Figure 6:
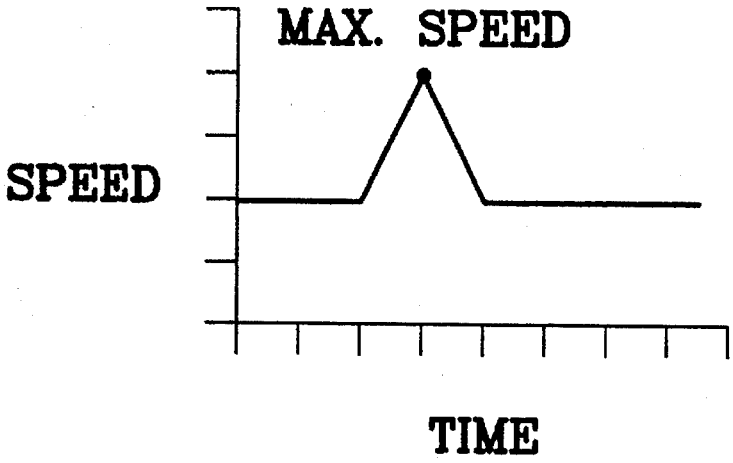
FIGS. 6 and 7 are schematic graphs showing two modes of acceleration and deceleration.

In the foregoing description of acceleration and deceleration of the transfer belt, it has been assumed that the deceleration begins to occur as soon as the maximum value of acceleration has occurred. This type of operation is illustrated in FIG. 6, and it will be apparent that, while the time period is minimized, the servo motors and all other components of the transfer belt system are subjected to maximum shocks and torque loads. Accordingly, the present invention includes a second mode of operation which has the advantage of substantially reducing wear on the components. This mode has particular applicability for use in processing shorter container blank sheets which have more distance between successive sheets, and therefore, have more time within which to make the speed adjustments.

Figure 7:
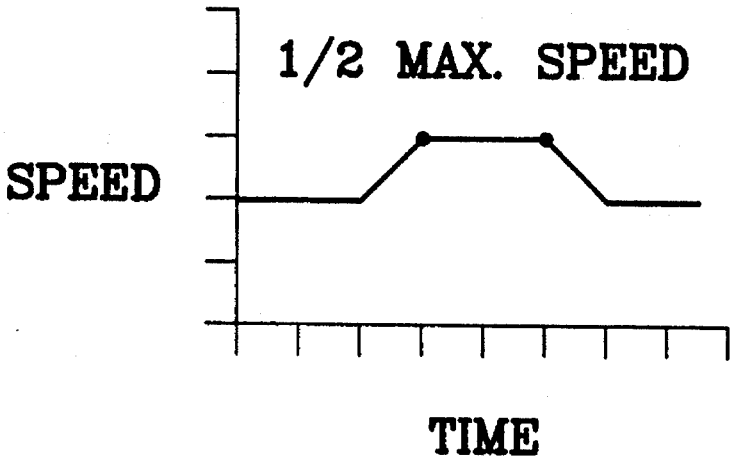

As shown in FIG. 7, instead of accelerating the belt to the maximum value shown in FIG. 6, the belt is only accelerated to a speed of ½ that amount, for example.

The belt is then operated at this increased, constant speed for a predetermined amount of time and is then decelerated to the line speed. As a result, the same amount of correction of registration is effected as in the mode of FIG. 6, but the torque loads on the motors and other components are substantially reduced.

As previously stated, the linear speed of the conveyor belts may be as high as 1,000 ft./min., and the spacing between sheets may be as short as 5 inches for 61 inch sheets. However, in the case of shorter sheets, the spacing between sheets increases such that it would be possible to have more time within which to make the registration adjustment if the sensor could detect the leading edge of the sheets at an earlier time; ie, at a position of the sheet which is not as far along the length of its travel. Accordingly, the present invention includes the addition of an adjustable position sensor 40B. For example, adjustable sensor 48B may be adjustably positioned by a finely-threaded screw 80 which is journaled in stationary bearing mounts 82, 84 and rotated by servo motor 86. In this manner, the linear position of the adjustable sensor 48B may be varied for shorter sheets; ie, moved to the right as viewed in FIG. 3 from the location of the fixed sensor at 78. The exact position of the adjustable sensor 48B may be determined by an encoder 88 driven by the shaft of servo motor 86. The importance of being able to move the sensor to a position so as to detect the sheet several inches earlier will be apparent from considering that the sheets are moving at 200 inches/second, and moving the sensor 5 inches to the right as viewed in FIG. 3 doubles the amount of time available for making an adjustment in registration. Also, the provision of fixed sensor at location 78 in addition to movable sensor 40B provides a separate sensor for detecting the leading edge of a sheet at pulley 66 and initiating the cycle to correct the linear position of the belt following a registration adjustment as previously described.

The foregoing description of several preferred embodiments is intended to be illustrative of the principles of the invention, rather than limiting thereof, and it is to be understood that the scope of the invention is not to be limited other than as set forth in the following claims interpreted under the doctrine of equivalents.

For example, instead of accelerating and then decelerating (or decelerating and then accelerating) the driven pulley 66 of the conveyor belt 54, a servo motor may change the configuration of the path of the conveyor belt to advance or retard the lower flight thereby adjusting the positional registration of the blank thereon. This may be done using a ball screw and nut arrangement driven by the servo motor for moving a belt idler pulley about the rotational axis of a drive pulley of the belt with the drive pulley being located above the vacuum box and partway along the upper flight of the belt-

What is claimed is:

1. A machine for processing paperboard sheets comprising in combination:

(a) first and second processing sections;

(b) conveyor means positioned entirely between said first and second processing sections for conveying sheets from said first processing section to said second processing section;

(c) means for detecting a displaced sheet out of registry with respect to said second processing section while said sheet is in said conveyor means;

(d) means for changing the speed of said conveyor means from a predetermined line speed to another speed and returning to said line speed to adjust the registry of said sheet relative to said second processing section, and (e) means for correcting the linear position of said conveyor means relative to said sheets so as to be returned to the linear position in which said conveyor means would have been if the speed of said conveyor means had not been changed from said line speed to adjust the registry of said sheet relative to said second processing section.

2. The machine for processing paperboard sheets according to claim 1 wherein at least one of said first and second processing sections comprises a printing section.

3. The machine for processing paperboard sheets according to claim 1 wherein each of said first and second processing sections comprises a printing section.

4. The machine for processing paperboard sheets according to claim 1 wherein said first processing section comprises a printing section and said second processing section comprises a die-cutter section.

5. The machine for processing paperboard sheets according to claim 1 wherein said conveyor means comprise a pair of side-by-side conveyor belts, and wherein said means for correcting the linear position of said conveyor means includes means for first correcting the linear position of one of said side-by-side belts and means for subsequently correcting the linear position of the other of said side-by-side belts.

6. The machine for processing paperboard sheets according to claim 1 wherein said conveyor means comprise a pair of side-by-side conveyor belts, one of said pair of conveyor belts having at least one vacuum aperture positioned to engage a leading portion of the sheet, the other of said pair of conveyor belts having at least one vacuum aperture positioned to engage a trailing portion of said sheet, and wherein said means for correcting the linear position of said conveyor means includes means for correcting the linear position of one of said conveyor belts before correcting the linear position of the other of said conveyor belts.

7. The machine for processing paperboard sheets according to claim 6 wherein said means for correcting the linear position of said conveyor means corrects the position of the belt having said vacuum aperture in engagement with the leading portion of the sheet before correcting the linear position of the belt having said vacuum aperture in engagement with the trailing portion of the sheet.

8. The machine according to claim 1 wherein said conveyor means comprise a pair of first and second side-by-side conveyor belts, said first conveyor belt having a series of vacuum apertures positioned for engaging a leading portion of the sheet, said second conveyor belt having a series of vacuum apertures positioned for engaging a trailing portion of the sheet, and wherein said means for correcting the linear position of said conveyor means includes means for correcting the position of said first belt when at least some of the apertures in said first belt have ceased to be in engagement with the leading portion of the sheet and while the vacuum apertures of said second belt remain in engagement with the trailing portion of the sheet.

9. The machine for processing paperboard sheets according to claim 1 wherein said means for detecting a displaced sheet is mounted on variable position mounting means for selectively positioning said detecting means at variable positions along the direction of travel of a sheet being conveyed through said conveyor means.

10. The machine of claim 9 wherein said variable position mounting means include support means for moving said means for detecting along the direction of travel of a sheet being conveyed through said conveyor section, and a motor connected to said support means to move said support means to selected positions along the direction of travel of said sheet for varying the position at which said sheet is sensed by said means for detecting.

11. The machine of claim 10 wherein said motor is a servo motor, and encoder means connected to said motor for producing a signal indicative of the selected position of said means for detecting.

* * * * *